US007165521B2

(12) United States Patent
Nakajima

(10) Patent No.: US 7,165,521 B2
(45) Date of Patent: Jan. 23, 2007

(54) VARIABLE VALVE TIMING CONTROL DEVICE

(75) Inventor: Shigeru Nakajima, Anjo (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/742,861

(22) Filed: Dec. 23, 2003

(65) Prior Publication Data

US 2004/0182342 A1 Sep. 23, 2004

(30) Foreign Application Priority Data

Dec. 24, 2002 (JP) ..... 2002-372411

(51) Int. Cl.
*F01L 1/34* (2006.01)

(52) U.S. Cl. ..... 123/90.17; 123/90.65; 123/90.67; 16/75; 267/277; 29/896.9; 29/896.91

(58) Field of Classification Search .. 123/90.15–90.18, 123/90.65, 90.67; 29/896.9, 896.91; 140/103; 72/135–138, 146; 16/72, 75, 76; 267/273, 267/275, 279, 285
See application file for complete search history.

(56) References Cited

U.S. PATENT DOCUMENTS

| | | | | |
|---|---|---|---|---|
| 4,605,387 | A * | 8/1986 | Okubo et al. | 474/112 |
| 5,454,150 | A * | 10/1995 | Hinke et al. | 29/896.9 |
| 5,558,053 | A * | 9/1996 | Tortul | 123/90.17 |
| 5,829,398 | A * | 11/1998 | Strauss et al. | 123/90.17 |
| 6,039,016 | A * | 3/2000 | Noguchi | 123/90.17 |
| 6,276,321 | B1 * | 8/2001 | Lichti et al. | 123/90.17 |
| 6,405,695 | B1 * | 6/2002 | Mizutani et al. | 123/90.17 |
| 6,463,896 | B1 * | 10/2002 | Fujiwara et al. | 123/90.11 |
| 6,662,769 | B1 | 12/2003 | Eguchi et al. | |
| 6,758,178 | B1 * | 7/2004 | Takahashi et al. | 123/90.17 |
| 6,769,386 | B1 * | 8/2004 | Shafer et al. | 123/90.17 |
| 2004/0221825 | A1 | 11/2004 | Nakajima | |

FOREIGN PATENT DOCUMENTS

| | | |
|---|---|---|
| DE | 298 17 140 U1 | 2/1999 |
| DE | 102 12 606 A1 | 10/2002 |
| DE | 103 39 669 A1 | 4/2004 |
| EP | 0 652 354 A1 | 5/1995 |
| JP | 2002-295208 A | 10/2002 |
| WO | WO 144628 A1 * | 6/2001 |

* cited by examiner

*Primary Examiner*—Thomas Denion
*Assistant Examiner*—Kyle M. Riddle
(74) *Attorney, Agent, or Firm*—Buchanan Ingersoll & Rooney PC

(57) ABSTRACT

A variable valve timing control device includes a rotational shaft, a rotation transmitting member assembled around the rotational shaft, and a vane assembled to one of the rotational shaft and the rotation transmitting member. The variable valve timing control device also includes a fluid pressure chamber defined between the rotational shaft and the rotation transmitting member and divided into a retarded angle chamber and an advanced angle chamber by the vane, a fluid passage through which an operation fluid is selectively supplied to or discharged from the advanced angle chamber or the retarded angle chamber, and a torsion coil spring for constantly biasing the rotational shaft to an advanced angle direction relative to the rotation transmitting member. The torsion coil spring is disposed between the rotational shaft and the rotation transmitting member under a condition that the torsion spring is compressed to a predetermined length from a free length.

20 Claims, 7 Drawing Sheets

VARIABLE VALVE TIMING CONTROL DEVICE

This application is based on and claims priority under 35 U.S.C. §119 with respect to Japanese Application No. 2002-372411 filed on Dec. 24, 2002, the entire content of which is incorporated herein by reference.

FIELD OF THE INVENTION

This invention generally relates to a variable valve timing control device. More particularly, the present invention pertains to a variable valve timing control device for controlling an opening and closing timing of an intake valve and an exhaust valve of an internal combustion engine.

BACKGROUND OF THE INVENTION

A known variable valve timing control device is disclosed in Japanese Patent Laid-Open Publication No. 2002-295208. This variable valve timing control device includes a shoe housing (rotation transmitting member) rotatable with one of a driving shaft and a driven shaft, and a vane rotor rotatable with the other one of the driving shaft and the driven shaft and having a vane that divides a concave portion formed in the shoe housing into an advanced angle chamber and a retarded angle chamber. The variable valve timing control device also includes a torsion coil spring whose one end engages with the shoe housing or a member rotatable as a unit with the shoe housing and whose other end engages with the vane rotor for biasing the vane rotor to an advanced angle side or a retarded angle side relative to the shoe housing. An end portion of the torsion coil spring engaging with the vane rotor is provided, being perpendicular to the axial direction of the van rotor. The vane rotor includes a hook groove formed in a direction perpendicular to the axial direction of the vane rotor and with which the end portion of the torsion coil spring engages.

According to the disclosed variable valve timing control device, a gap is formed around substantially entire outer circumference of the end portion of the torsion coil spring when the end portion of the torsion coil spring engages with the hook groove of the rotor. Therefore, the vibration of an internal combustion engine and a chain system, the pulsation of the fluid pressure, the friction of cams and a resultant force thereof cause the torsion coil spring to vibrate in the axial direction, the vertical direction and the rotational direction via the gap whereby the resonance is generated torsion coil spring under a predetermined frequency. Due to this resonance, an appropriate torque for biasing the vane rotor on the advanced angle side or the retarded angle side cannot be assured by the torsion coil spring and thus a poor performance of the variable valve timing may be caused. In addition, a problem such as the abrasion development in each contact portion of each member and a fatigue fracture of the torsion coil spring itself may be raised. Thus, a need exists for a variable valve timing control device that can prevent the vibration of the torsion coil spring.

SUMMARY OF THE INVENTION

According to an aspect of the present invention, a variable valve timing control device for controlling an opening and closing timing of an intake valve and an exhaust valve includes a rotational shaft rotatably assembled to a cylinder head of an internal combustion engine, a rotation transmitting member assembled around the rotational shaft so as to rotate relative thereto within a predetermined range and receiving a rotational force from a crank shaft, and a vane assembled to one of the rotational shaft and the rotation transmitting member. The variable valve timing control device also includes a fluid pressure chamber defined between the rotational shaft and the rotation transmitting member and divided into a retarded angle chamber and an advanced angle chamber by the vane, a fluid passage through which an operation fluid is selectively supplied to or discharged from the advanced angle chamber or the retarded angle chamber, and a torsion coil spring for constantly biasing the rotational shaft to an advanced angle direction relative to the rotation transmitting member. The torsion coil spring is disposed between the rotational shaft and the rotation transmitting member under a condition that the torsion spring is compressed to a predetermined length from a free length.

According to another aspect of the present invention, a variable valve timing control device for controlling an opening and closing timing of an intake valve and an exhaust valve includes a rotational shaft rotatably assembled to a cylinder head of an internal combustion engine, a rotation transmitting member assembled around the rotational shaft so as to rotate relative thereto within a predetermined range and receiving a rotational force from a crank shaft, and a vane assembled to one of the rotational shaft and the rotation transmitting member. The variable valve timing control device also includes a fluid pressure chamber defined between the rotational shaft and the rotation transmitting member and divided into a retarded angle chamber and an advanced angle chamber by the vane, a fluid passage through which an operation fluid is selectively supplied to or discharged from the advanced angle chamber or the retarded angle chamber, and a torsion coil spring for constantly biasing the rotational shaft to an advanced angle direction relative to the rotation transmitting member. The torsion coil spring includes a winding portion and hook portions extending from both ends of the winding portion and engaging with the rotational shaft and the rotation transmitting member respectively. One winding of at least one end side of the winding portion and the hook portions of the torsion coil spring include plane faces respectively, which are formed in an axially outward direction of the winding portion and in perpendicular to an axial direction of the winding portion.

According to further another aspect of the present invention, a variable valve timing control device for controlling an opening and closing timing of an intake valve and an exhaust valve includes a rotational shaft rotatably assembled to a cylinder head of an internal combustion engine, a rotation transmitting member assembled around the rotational shaft so as to rotate relative thereto within a predetermined range and receiving a rotational force from a crank shaft, and a vane assembled to one of the rotational shaft and the rotation transmitting member. The variable valve timing control device also includes a fluid pressure chamber defined between the rotational shaft and the rotation transmitting member and divided into a retarded angle chamber and an advanced angle chamber by the vane, a fluid passage through which an operation fluid is selectively supplied to or discharged from the advanced angle chamber or the retarded angle chamber, and a torsion coil spring for constantly biasing the rotational shaft to an advanced angle direction relative to the rotation transmitting member and disposed between the rotational shaft and the rotation transmitting member under a condition that the torsion spring is compressed to a predetermined length from a free length. The torsion coil spring includes a winding portion and hook portions extending from both ends of the winding portion and engaging with the rotational shaft and the rotation transmitting member respectively. One winding of at least one end side of the winding portion and the hook portions of the torsion coil spring include plane faces respectively, which are formed in an axially outward direction of the winding portion and in perpendicular to an axial direction of the winding portion.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

Figure 5A:
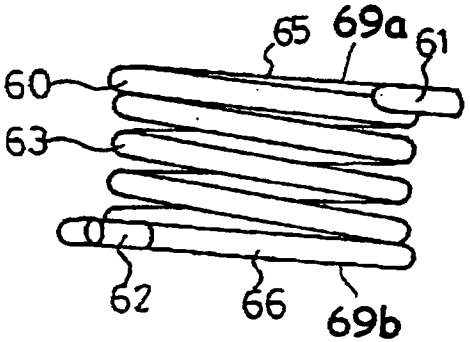
Figure 5B:
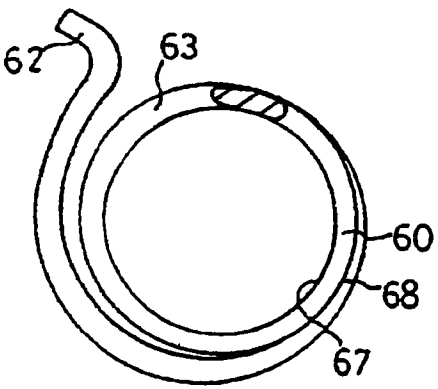

FIG. 5*a* is a front view of a torsion spring whose hook portion formed at a winding portion extends outward relative to an outer diameter of the torsion spring according to the embodiment of the present invention;

FIG. 5*b* is a cross-sectional view of the torsion spring of FIG. 5*a;*

Figure 6A:
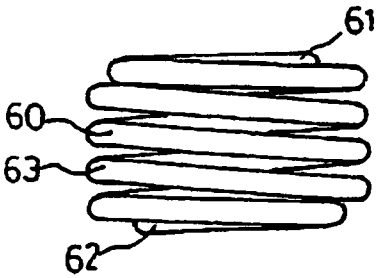
Figure 6B:
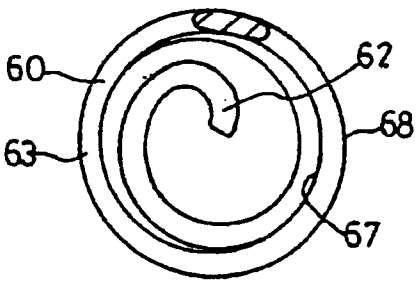

FIG. 6*a* is a front view of the torsion spring whose hook portion formed at the winding portion extends inward relative to an inner diameter of the torsion spring according to the embodiment of the present invention;

FIG. 6*b* is a cross-sectional view of the torsion spring of FIG. 6*a;*

Figure 7A:
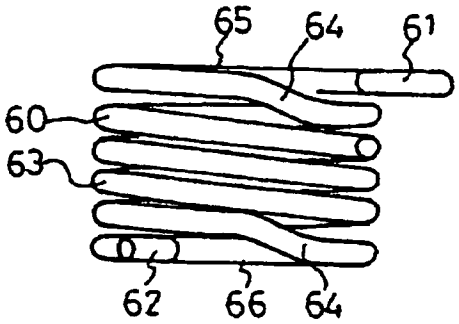
Figure 7B:
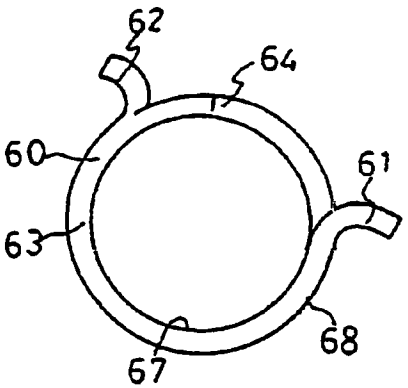

FIG. 7*a* is a front view of the torsion spring whose end portion of the winding portion is provided with a bending portion;

FIG. 7*b* is a top view of the torsion spring of FIG. 7*a;*

Figure 8:
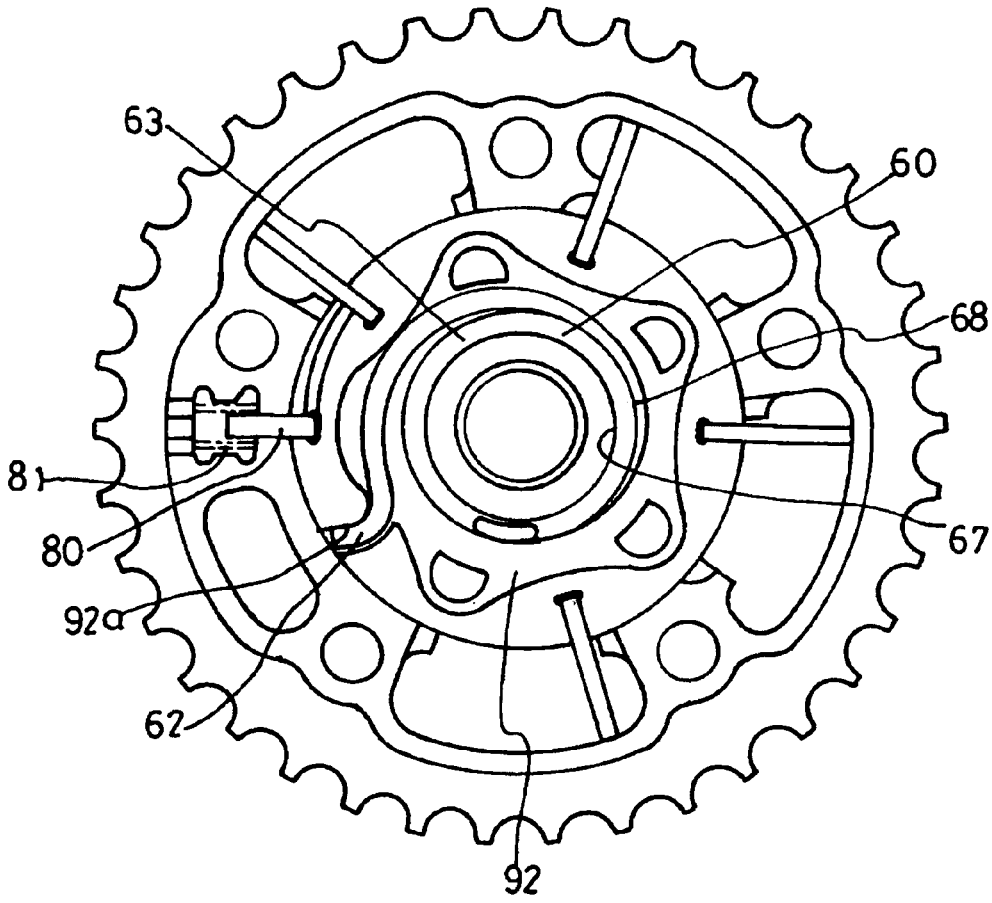
Figure 9:
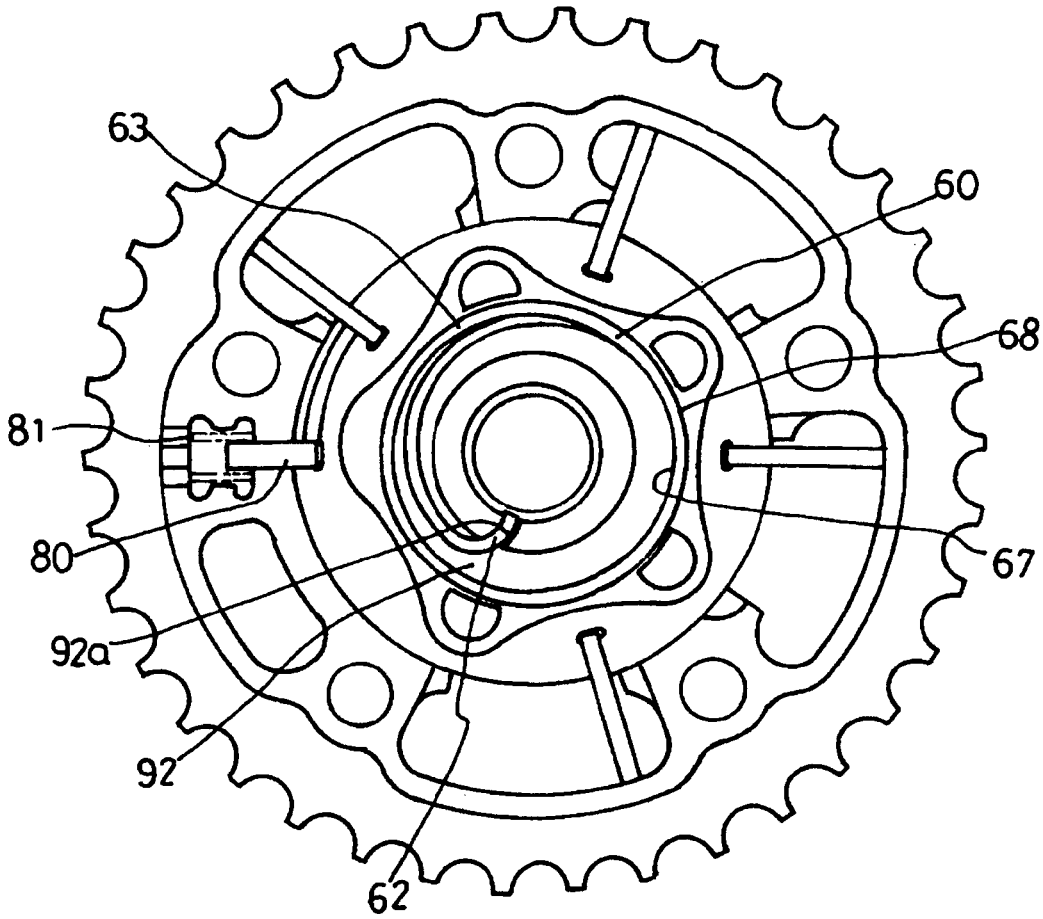

FIG. 8 is a front view of the variable valve timing control device equipped with the torsion spring of FIGS. 6*a* and 6*b*, with the front plate removed; and FIG. 9 is a front view of the variable valve timing control device equipped with the torsion spring of FIG. 6, with the front plate removed.

DETAILED DESCRIPTION OF THE INVENTION

An embodiment of the present invention is explained referring to attached drawings.

Figure 1:
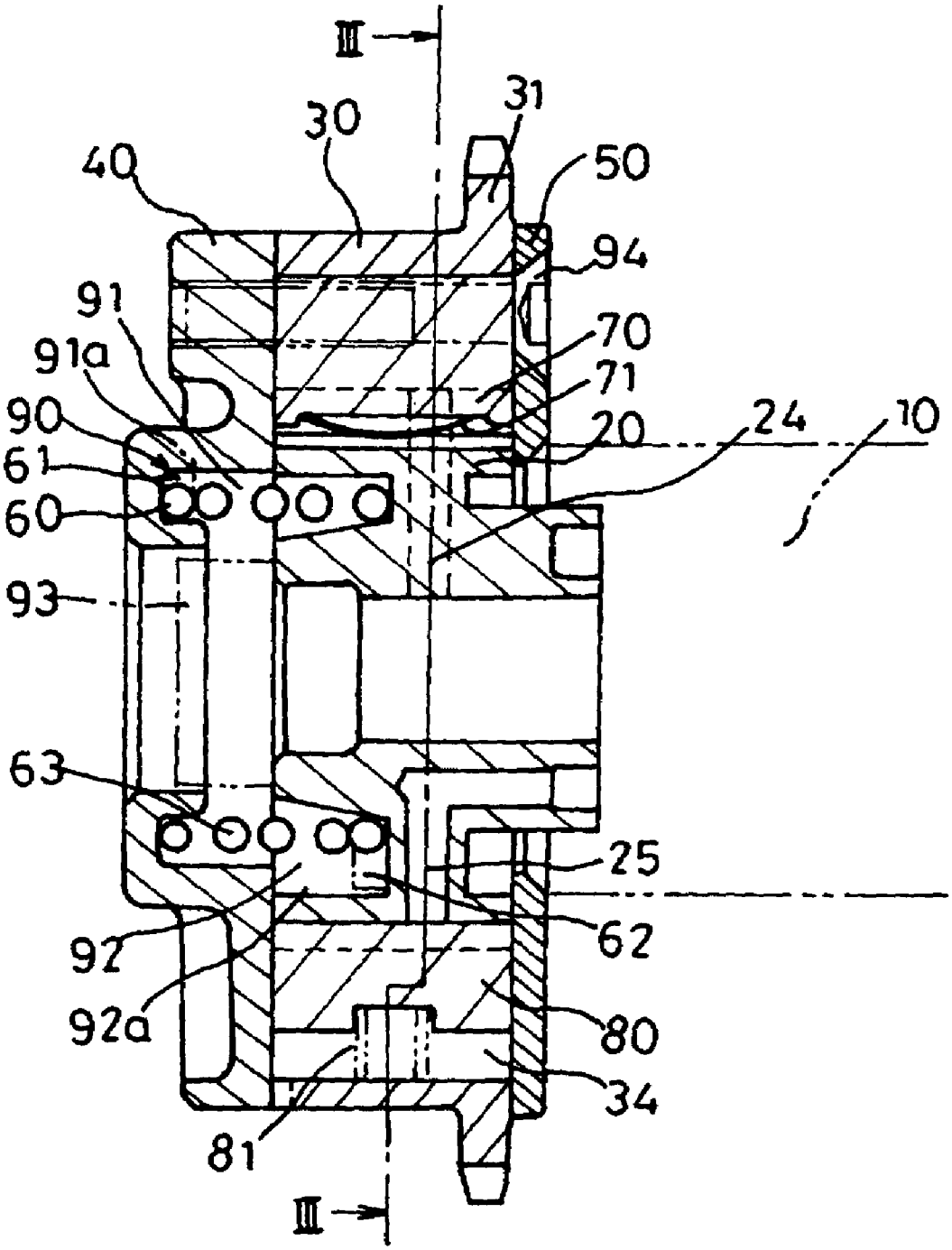
FIG. 1 is a longitudinal sectional view of a variable valve timing control device according to an embodiment of the present invention.
Figure 2:
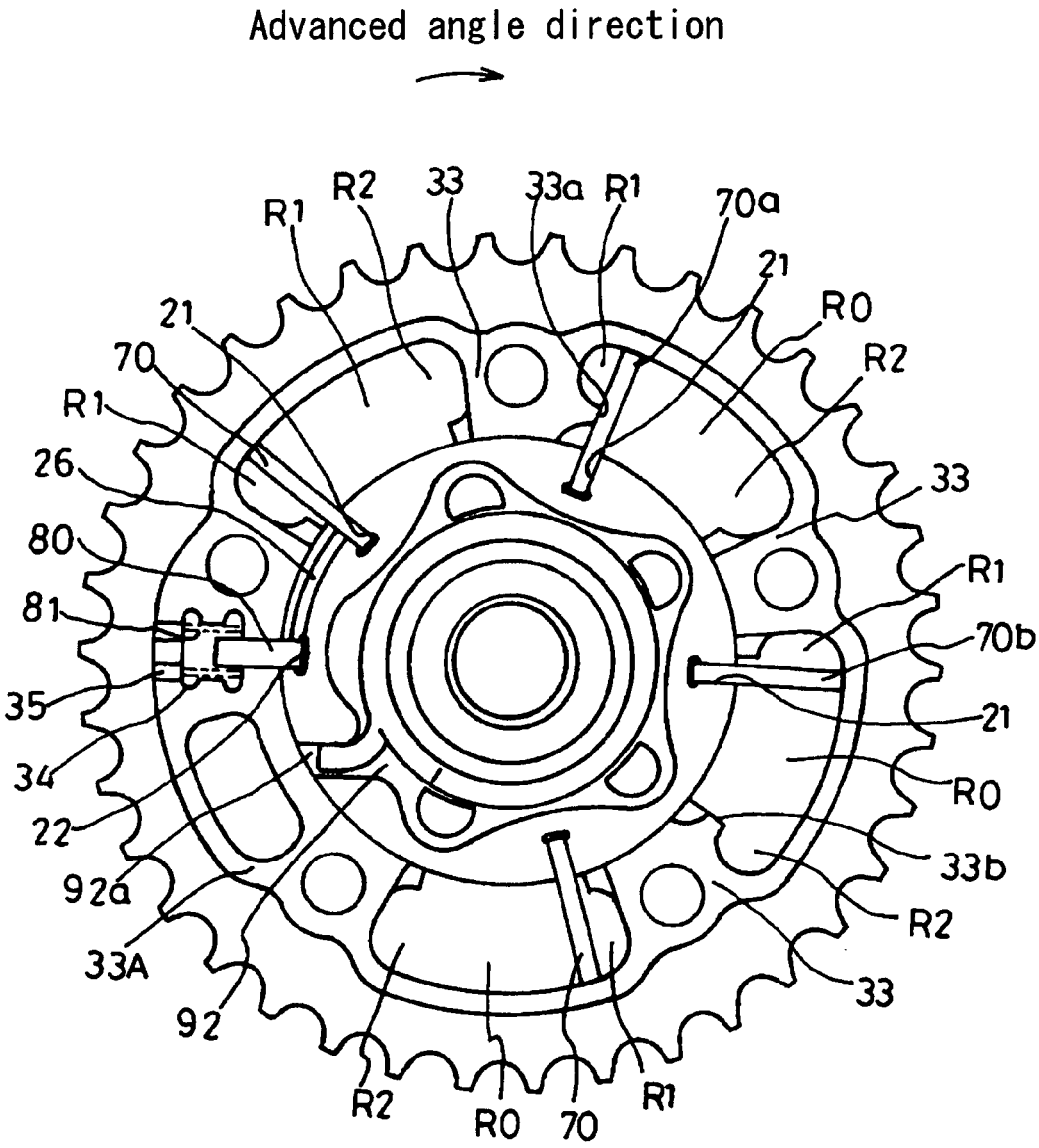
FIG. 2 is a front view of the variable valve timing control device of FIG. 1, with a front plate removed.

A variable valve timing control device shown in FIGS. 1 and 2 includes a rotational shaft consisting of a camshaft 10 having cams rotatably supported on a cylinder head (not shown) of an internal combustion engine for opening or closing a valve, and a rotor 20 integrally fixed to a tip end portion of the camshaft 10. The variable valve timing control device also includes a rotation transmitting member consisting of a housing 30, a front plate 40 and a rear plate 50 assembled around the rotor 20 so as to rotate relative thereto within a predetermined angle, and a timing sprocket 31 integrally formed on an outer periphery of the housing 30. The variable valve timing control device further includes a torsion spring (torsion coil spring) 60 disposed between the rotor 20 and the front plate 40, four vanes 70 assembled to the rotor 20, a lock key 80 assembled to the housing 30, and the like.

As shown in FIG. 1, the housing 30 is assembled on the outer periphery of the rotor 20 so as to rotate relative thereto within the predetermined angle. Both side portions of the housing 30 in the axial direction thereof are integrally fixed to the front plate 40 and the rear plate 50 respectively via five connecting bolts 94. The timing sprocket 31 is integrally formed on the outer periphery of the housing 30 on the rear side, i.e. the side where the rear plate 50 is fixed. A transmission member such as a timing chain (not shown) and, a timing belt (not shown) is disposed between the timing sprocket 31 and a sprocket of a crankshaft (not shown) of the internal combustion engine. When the crankshaft of the internal combustion engine is driven together with the sprocket thereof, the timing sprocket 31 is rotated via the transmission member such as the timing chain and the timing belt. Then, the housing 30 rotates with the front plate 40 and the rear plate 50, thereby rotating the rotor 20 and the camshaft 10 that is integrally connected to the rotor 20. Finally, the cams of the camshaft 10 push up to open or close the valve of the internal combustion engine.

Figure 3:
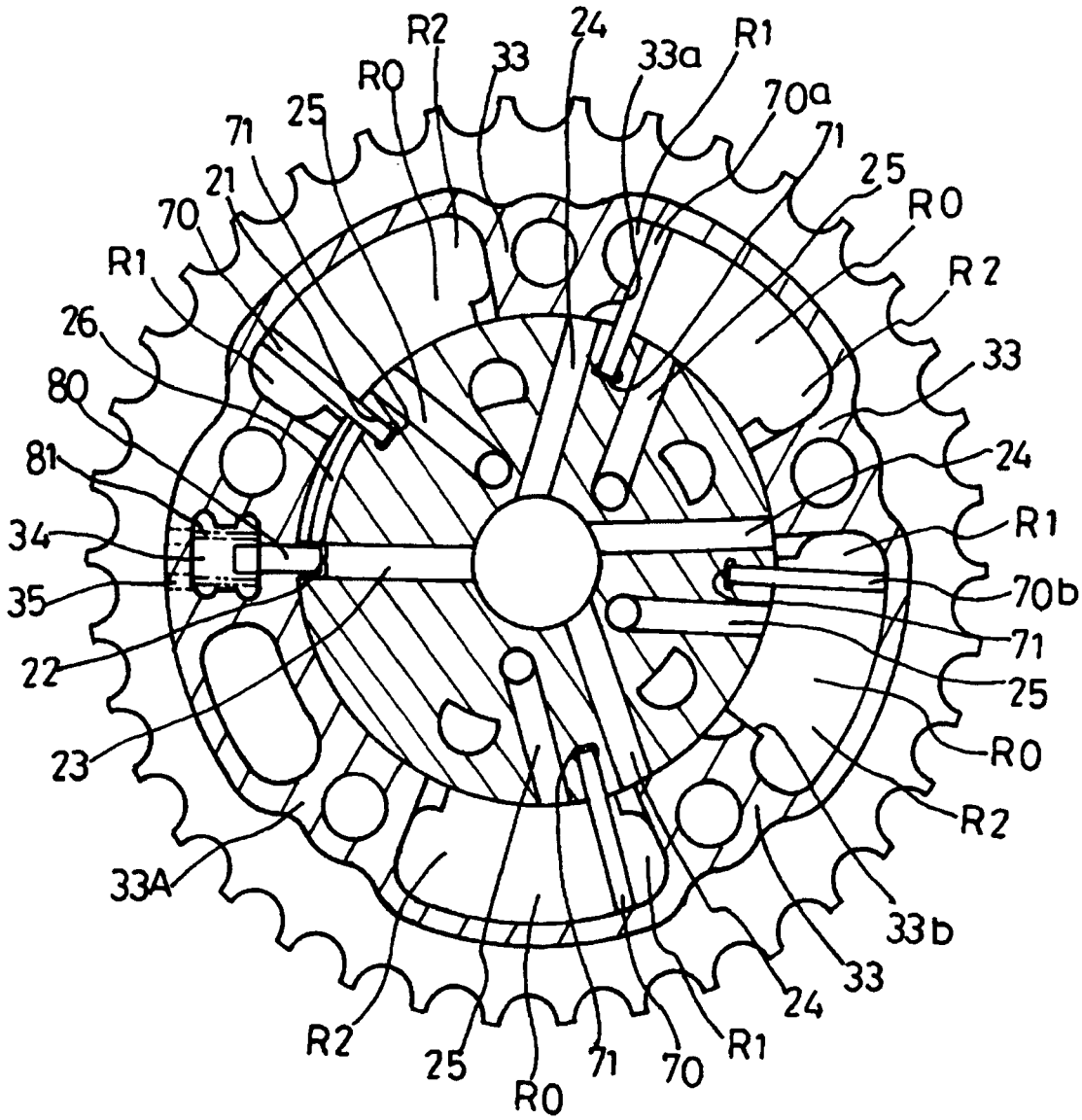
FIG. 3 is a cross-sectional view taken along a line III—III of FIG. 1.

As shown in FIGS. 2 and 3, four projecting portions 33 are formed in the housing 30 at predetermined intervals in the circumferential direction so as to project in the radially inward direction. Each inner circumferential face of each projecting portion 33 is slidably in contact with an outer circumferential face of the rotor 20. That is, the housing 30 is rotatably supported on the rotor 20. Each fluid pressure chamber R0 is defined by the projecting portions 33 adjacent to each other and the outer circumferential face of the rotor 20. One projecting portion 33A out of the projecting portions 33 is formed with a retracting groove 34 accommodating the lock key 80 and a spring 81 for biasing the lock key 80, and a communication groove 35 for connecting the retracting groove 34 to an outside. The projecting portion 33A obtains a greater width in the circumferential direction as compared to other projecting portions 33 so that the rigidity in the circumferential direction of the housing 30 can be assured.

The rotor 20 is integrally fixed to the camshaft 10 via single installation bolt 93 and includes vane grooves 21 for holding the vanes 70 respectively so that each vane 70 can move in the radial direction of the rotor 20. In addition, the rotor 20 includes a receiving bore 22 into which a tip portion of the lock key 80 having a plate shape is inserted by a predetermined amount when the rotor 20 is in a state shown in FIGS. 2 and 3, i.e. when a relative phase between the rotor 20 and the housing 30 is equal to a predetermined phase (i.e. most retarded angle phase). The rotor 20 also includes a passage 23 through which the operation fluid can be supplied to or discharged from the receiving bore 22 by way of circumferential grooves 26. The circumferential grooves 26 extending in the circumferential direction of the rotor 20 are formed in respective portions adjacent to the outer periphery, axially on both sides of the rotor 20. The rotor 20 further includes a retarded angle fluid passage (fluid passage) 25 through which the operation fluid is supplied to or discharged from a retarded angle chamber R2 defined by the vane 70 and an advanced angle fluid passage (fluid passage) 24 through which the operation fluid is supplied to or discharged from an advanced angle chamber R1 defined by the vane 70. Each vane 70 is biased in the radially outward direction by each vane spring 71 accommodated at a bottom portion of the vane groove 21.

Figure 4:
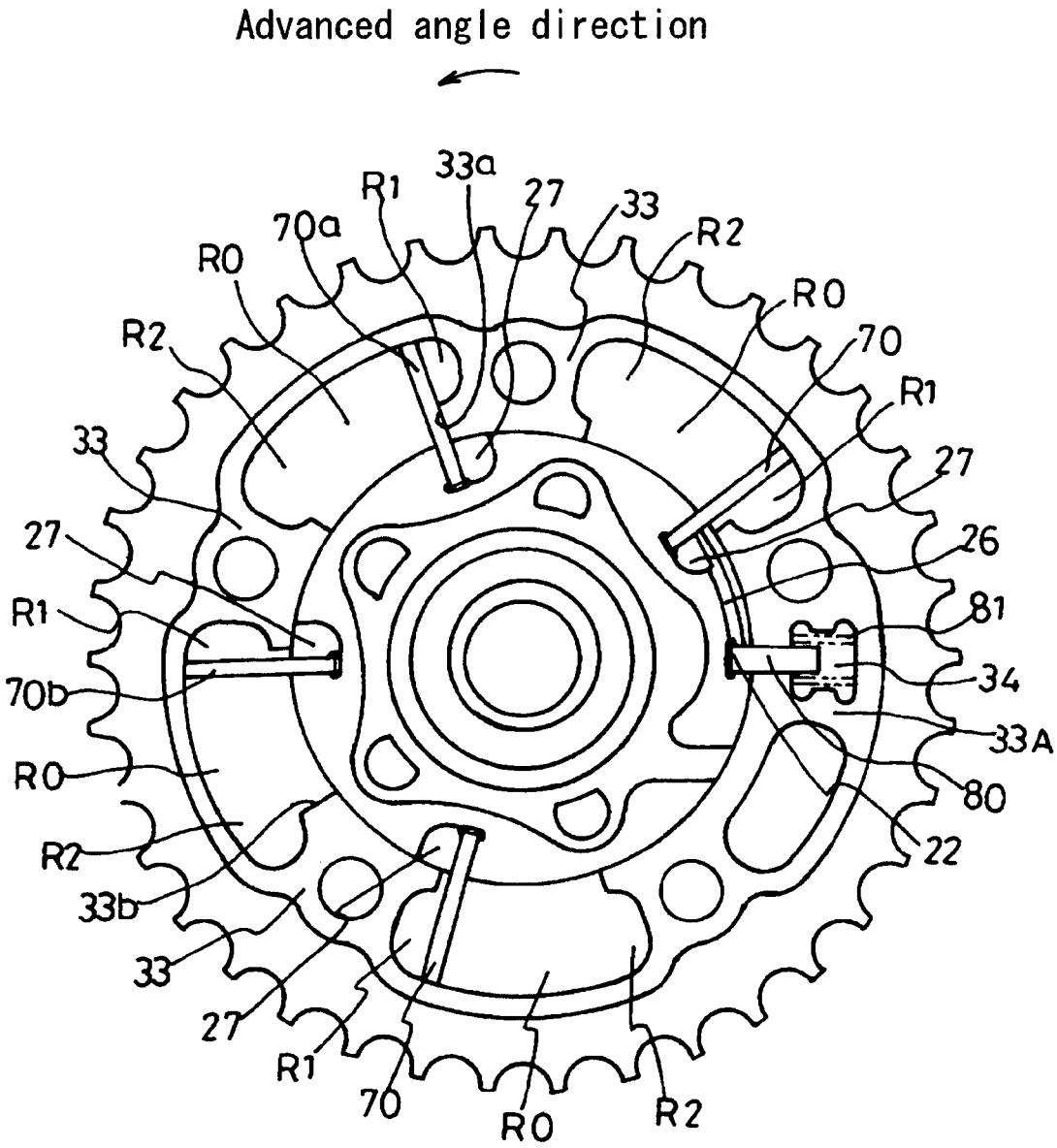
FIG. 4 is a rear view of the variable valve timing control device of FIG. 1, with a rear plate removed.

As shown in FIG. 4, a groove 27 is formed at the vane groove 21 of the rotor 20 on the camshaft 10 side for connecting the vane groove 21 and the advanced angle chamber R1. The operation fluid (pressure) provided to the advanced angle chamber R1 is supplied to the vane groove 21 via the groove 27. The operation fluid supplied to the vane groove 21 assists the vane spring 71 to bias the vane 70 in the radially outward direction so that the tip end portion of each vane 70 and the inner circumferential face of the housing 30 are prevented from separating from each other. In addition, the operation fluid supplied to the vane groove 21 biases the rotor 20 to the front plate 40 side so that the rotor 20 and the rear plate 50, which are of the same material, are prevented from adhering to each other due to the sliding therebetween. Further, the sliding portion between the rotor 20 and the rear plate 50 is lubricated by the operation fluid supplied to the groove 27. In this case, the rotor 20 is biased to the front cover 40 side by the operation fluid supplied to the groove 27 and thus the torsion spring 60 disposed between the rotor 20 and the front plate 40 made of aluminum is desired to have a larger compressive load in order to prevent the sliding between the rotor 20 and the front plate 40. Moreover, it is effective to employ the torsion spring 60 with irregular pitches. The spring constant of the torsion spring 60 in case of the torsion spring 60 being compressed may be increased, thereby improving the performance of the torsion spring 60 against the resonance.

An operation of the present embodiment is explained as follows. When the internal combustion engine stops, the rotor 20 is positioned at the most retarded angle phase relative to the housing 30 as shown in FIGS. 2 and 3. One vane 70*a* out of the plural vanes 70 is in contact with an end face 33*a* of the projecting portion 33 to which the vane 70*a* faces, and therefore functions as a stopper in the retarded angle direction to prevent the rotor 20 from rotating in the retarded angle direction. In this case, in addition, the tip portion of the lock key 80 is positioned in the receiving bore 22 to thereby restrict the movement of the rotor 20. The lock key 80 functions as a stopper in the advanced angle direction. Therefore, the rotor 20 cannot rotate in the advanced angle direction or the retarded angle direction relative to the housing 30 and whose movement is restricted. The internal combustion engine is desired to start in a state such that the movement of the rotor 20 is restricted as mentioned above. At a time of the start of the internal combustion engine, the fluid pressure of the internal combustion engine is not sufficiently stable. Then, the vane 70 is likely to move in the circumferential direction of the rotor 20 and hits each end face of the adjacent projecting portion 33. However, since the function as the stoppers in the advanced angle direction and the retarded angle direction is effective as mentioned above, the vane 70 may be prevented from hitting the end face of the adjacent projecting portion 33 at a time immediately after starting of the internal combustion engine.

When the fluid pressure of the internal combustion engine becomes stable after a predetermined time has passed from the start of the internal combustion engine, the operation fluid is supplied to the receiving bore 22 via the passage 23 formed on the rotor 20, thereby pushing the tip portion of the lock key 80. Then, the lock key 80 is shifted to the radially outward direction and the rotor 20 is released to move. When the function of the lock key 80 as the stopper is thus deactivated, the relative rotation of the rotor 20 to the housing 30 is permitted and then the rotational phase of the camshaft 10 relative to that of the crankshaft can be adjusted in the retarded angle direction or the advanced angle direction.

In this case, when the operation fluid is discharged from the retarded angle chamber R2 via the retarded angle fluid passage 25 and at the same time, supplied to the advanced angle chamber R1 via the advanced angle fluid passage 24, the rotor 20 rotates together with the vanes 70 in the advanced angle direction relative to the housing 30 so as to increase a capacity of the advanced angle chamber R1 and decrease a capacity of the retarded angle chamber R2. At the most advanced angle phase of the rotor 20 relative to the housing 30, one vane 70*b* out of the plural vanes 70 is in contact with an end face 33*b* of the projecting portion 33 to which the vane 70*b* faces, and therefore functions as a stopper in the advanced angle direction to prevent the rotor 20 from rotating in the advanced angle direction.

Meanwhile, when the operation fluid is supplied to the retarded angle chamber R2 via the retarded angle fluid passage 25 and at the same time, discharged from the advanced angle chamber R1 via the advanced angle fluid passage 24 when the lock key 80 does not function as the stopper, the rotor 20 rotates together with the vanes 70 in the retarded angle direction relative to the housing 30 so as to increase the capacity of the retarded angle chamber R2 and decrease the capacity of the advanced angle chamber R1.

According to the present embodiment as shown in FIG. 1, a receiving space. 90 for accommodating the torsion spring 60 is annularly and coaxially defined by the front plate 40 and the rotor 20. The receiving space 90 includes an annular first receiving groove 91 formed in the front plate 40 and opening from an end face thereof in contact with the rotor 20, and an annular second receiving groove 92 formed in the rotor 20 and opening from an end face thereof in contact with the front plate 40.

The first receiving groove 91 of the front plate 40 includes a first engaging portion 91*a* denting in the radially outward direction from a face of the first receiving groove 91. The second receiving groove 92 includes a second engaging portion 92*a* denting in the radially outward direction from a face of the receiving groove 92.

As shown in FIG. 1, the torsion spring 60 is accommodated in the receiving space 90 so as to be substantially coaxial with the rotor 20. As shown in FIGS. 1, 6 through 7, the torsion spring 60 is formed by bending the metal wire rods with a circular-shaped cross section into a coil shape. The torsion spring 60 includes a winding portion 63 having an axial center along an axial center of the rotor 20, a first hook portion 61 extending in the radially outward direction of the winding portion 63 from a first end 66 positioned in the axially outward direction of the winding portion 63, and a second hook portion 62 extending in the radially outward direction of the winding portion 63 from a second end 66 positioned in the axially outward direction of the winding portion 63. The first hook portion 61 engages with the first engaging portion 91*a* while the second hook portion 62 engages with the second engaging portion 91*b*.

According to the present embodiment as shown in FIGS. 1, 5*a* and 5*b*, the torsion spring 60 is disposed between the front plate 40 and the rotor 20 under a condition of being compressed to a predetermined length from a free length thereof. Therefore, the installing posture of the torsion spring 60 can be maintained, and the vibration of the torsion spring 60 in the axial direction, the vertical direction and the rotational direction can be prevented. Further, the appropriate torque for biasing the rotor 20 can be assured by the torsion spring 60 in addition to the decrease of the abrasion of the contact portion between the front plate 40, the rotor 20 and the torsion spring 60. Moreover, flat planes are formed on substantially one winding of the first end 65 and the first hook portion 61 extending therefrom and engaging with the front plate 40. Each flat plane is formed in an axially outward direction of the winding portion 63, i.e., on a portion where a ridge line 69*a* on the axially first outward side of the winding portion 63 is positioned. In the same way, flat planes are formed on substantially one winding of the second end 66 and the second hook portion 62 extending therefrom and engaging with the rotor 20. Each flat plane is formed in an axially outward direction of the winding portion 63, i.e., on a position where a ridge line 69*b* on the axially second outward side of the winding portion 63 is positioned. The flat planes formed on the first and second ends 65 and 66 and the first and second hook portions 61 and 62 are perpendicular to the axial direction of the winding portion 63. Therefore, the installation posture of the torsion spring 60 can be stably maintained. Further, the flat planes formed on the first and second ends 65 and 66 respectively and bottom faces of the first and second receiving grooves 91 and 92 of the front plate 40 and the rotor 20 respectively and of the first and second engaging portions 91*a* and 92*a* with which the plane faces formed on the first and second hook portions 61 and 62 are in contact respectively are perpendicular to the axial direction of the winding portion 63. Thus, the simplified molding dies, the equalized sintered density, the reduced length in the axial direction, and the reduced mass of the front plate 40 and the rotor 20 may be achieved. Since each winding pitch of the first end 65 side and the second end 66 side is irregular, i.e., unequal to the others, the spring constant may be increased when the torsion spring 60 is compressed, thereby improving the performance against the resonance.

According to the present embodiment, the first hook portion 61 and the second hook portion 62 may extend outward relative to an outer diameter 68 of the winding portion 63 as shown in FIGS. 5*a*, 5*b* and 8 when specifying the flat planes formed on the first and second ends 65 and 66 and the first and second hook portions 61 and 62 to be perpendicular to the axial direction of the winding portion 63. The productivity of the torsion spring 60 may be improved accordingly.

In addition, according to the present embodiment, the first hook portion 61 and the second hook portion 62 may extend inward relative to an inner diameter 67 of the winding portion 63 as shown in FIGS. 6 and 9 when specifying the flat planes formed on the first and second ends 65 and 66 and the first and second hook portions 61 and 62 to be perpendicular to the axial direction of the winding portion 63. The productivity of the torsion spring 60 may be improved accordingly.

Further, according to the present embodiment, a bending portion 64 may be formed on at least one end portion of the winding portion 63 as shown in FIG. 7 when specifying the flat planes formed on the first and second ends 65 and 66 and the first and second hook portions 61 and 62 to be perpendicular to the axial direction of the winding portion 63. The structure of the first receiving groove 91 and the second receiving groove 92 may be simplified accordingly.

The torsion spring 60 constantly biases the rotor 20 holding the vanes 70 in the clockwise direction of FIG. 2 relative to the housing 30. The torsion spring 60 is employed since a force applied to the rotor 20 to rotate on the retarded angle side relative to the housing 30 (i.e. force for preventing the rotor 20 from rotating in the advanced angle direction relative to the housing 30) is caused by the fluctuation torque applied to the camshaft 10 under the internal combustion engine operated. The torsion spring 60 constantly biases the rotor 20 in the advanced angle direction relative to the housing 30, thereby improving the response of the rotor 20 to operate in the advanced angle direction.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

What is claimed is:

1. A variable valve timing control device for controlling an opening and closing timing of an intake valve and an exhaust valve comprising:

a rotational shaft rotatably assembled to a cylinder head of an internal combustion engine;

a rotation transmitting member assembled around the rotational shaft so as to rotate relative thereto within a predetermined range and receiving a rotational force from a crank shaft;

a vane assembled to either one of the rotational shaft or the rotation transmitting member;

a fluid pressure chamber disposed between the rotational shaft and the rotation transmitting member and divided into a retarded angle chamber and an advanced angle chamber by the vane;

a fluid passage through which an operation fluid is selectively supplied to or discharged from the advanced angle chamber or the retarded angle chamber; and a torsion coil spring for constantly biasing the rotational shaft to an advanced angle direction relative to the rotation transmitting member;

wherein the rotational shaft and the rotation transmitting member possess contact portions facing each other in an axial direction; and the torsion coil spring is disposed between the rotational shaft and the rotation transmitting member under condition that one end of the torsion coil spring engages the rotational shaft and another end of the torsion coil spring engages the rotation transmitting member, while the torsion spring is axially compressed to a predetermined length from a free length so as to generate a force in a direction urging the contact portions of the rotational shaft and the rotation transmitting member away from one another.

2. A variable valve timing control device according to claim 1, wherein a winding pitch of at least one of the both ends of a winding portion is irregular.

3. A variable valve timing control device according to claim 1, wherein at least one hook portion extends outward relative to an outer diameter of a winding portion.

4. A variable valve timing control device according to claim 1, wherein at least one hook portion extends inward relative to an inner diameter of a winding portion.

5. A variable valve timing control device according to claim 1, wherein at least one hook portion is provided with a bending portion.

6. A variable valve timing control device according to claim 1, wherein the rotational shaft includes a camshaft having cams rotatably supported on the cylinder head of the internal combustion engine for opening or closing a valve, and a rotor integrally fixed to a tip end portion of the camshaft.

7. A variable valve timing control device according to claim 6, wherein the rotation transmitting member includes a housing, a front plate, a rear plate, and a timing sprocket which is integrally formed on an outer periphery of the housing.

8. A variable valve timing control device according to claim 1, wherein a groove is formed at a vane groove of either one of the rotational shaft or the rotation transmitting member on a camshaft side for connecting the vane groove and the advanced angle chamber.

9. A variable valve timing control device according to claim 1, wherein the rotation shaft includes a rotor, and the rotation transmitting member includes a housing, a rear plate and a front plate assembled around the rotor, and the torsion coil spring is disposed between the rotor and the front plate so as to urge the rotor toward the rear plate.

10. A variable valve timing control device according to claim 9, wherein the rotor and the rear plate are made of the same material, and the front plate is made of aluminum.

11. A variable valve timing control device according to claim 9, wherein a groove is formed between the rear plate and the rotor, the groove is connected to the fluid pressure chamber so that a sliding portion between the rotor and the rear plate is lubricated by the operation fluid supplied to the groove.

12. A variable valve timing control device for controlling an opening and closing timing of an intake valve and an exhaust valve comprising:

a rotational shaft rotatably assembled to a cylinder head of an internal combustion engine;

a rotation transmitting member assembled around the rotational shaft so as to rotate relative thereto within a predetermined range and receiving a rotational force from a crank shaft;

a vane assembled to either one of the rotational shaft or the rotation transmitting member;

a fluid pressure chamber disposed between the rotational shaft and the rotation transmitting member and divided into a retarded angle chamber and an advanced angle chamber by the vane;

a fluid passage through which an operation fluid is selectively supplied to or discharged from the advanced angle chamber or the retarded angle chamber; and a torsion coil spring for constantly biasing the rotational shaft to an advanced angle direction relative to the rotation transmitting member;

wherein the rotational shaft and the rotation transmitting member have contact portions facing each other in axial direction; and the torsion coil spring is disposed between the rotational shaft and the rotation transmitting member under condition that one end of the torsion coil spring engages the rotational shaft and another end of the torsion coil spring engages the rotation transmitting member, while the torsion spring is axially compressed to a predetermined length from a free length so as to generate a force in a direction urging the contact portions of the rotational shaft and the rotation transmitting member away from one another;

the torsion coil spring comprising a winding portion and hook portions extending from both ends of the winding portion and engaging the rotational shaft and the rotation transmitting shaft respectively; and substantially one winding of at least one end side of the winding portion and the hook portions of the torsion coil spring include plane faces respectively which are formed perpendicularly to an axial direction of the winding portion.

13. A variable valve timing control device according to claim 12, wherein a winding pitch of at least one of the both ends of the winding portion is irregular.

14. A variable valve timing control device according to claim 12, wherein at least one of the hook portions extends outward relative to an outer diameter of the winding portion.

15. A variable valve timing control device according to claim 12, wherein at least one of the hook portions extends inward relative to an inner diameter of the winding portion.

16. A variable valve timing control device according to claim 12, wherein at least one of the hook portions is provided with a bending portion.

17. A variable valve timing control device according to claim 12, wherein the rotational shaft includes a camshaft having cams rotatably supported on the cylinder head of the internal combustion engine for opening or closing a valve, and a rotor integrally fixed to a tip end portion of the camshaft.

18. A variable valve timing control device according to claim 17, wherein the rotation transmitting member includes a housing, a front plate and a rear plate assembled around the rotor, and a timing sprocket integrally formed on an outer periphery of the housing.

19. A variable valve timing control device according to claim 12, wherein a groove is formed at a vane groove of either one of the rotational shaft or the rotation transmitting member on a camshaft side for connecting the vane groove and the advanced angle chamber.

20. A variable valve timing control device according to claim 12, wherein the rotation shaft includes a rotor, and the rotation transmitting member includes a housing, a rear plate and a front plate assembled around the rotor, and the torsion coil spring is disposed between the rotor and the front plate so as to urge the rotor toward the rear plate, and the rotor and the rear plate are made of the same material, and the front plate is made of aluminum.

* * * * *